US007311554B1

(12) United States Patent
Jackson et al.

(10) Patent No.: US 7,311,554 B1
(45) Date of Patent: Dec. 25, 2007

(54) COMPACT COMPRESSION CONNECTOR WITH FLEXIBLE CLAMP FOR CORRUGATED COAXIAL CABLE

(75) Inventors: David Jackson, Manlius, NY (US); Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/505,961

(22) Filed: Aug. 17, 2006

(51) Int. Cl.
*H01R 9/05* (2006.01)

(52) U.S. Cl. ..... 439/584

(58) Field of Classification Search ..... 439/584, 439/585, 578
See application file for complete search history.

(56) References Cited

U.S. PATENT DOCUMENTS 3,725,846 A * 4/1973 Strain ..... 439/89
3,744,128 A * 7/1973 Fisher et al. ..... 29/858
3,963,321 A 6/1976 Burger et al.
4,046,451 A 9/1977 Juds et al.
4,241,967 A 12/1980 Collins
4,549,755 A 10/1985 Kot et al.
4,687,272 A 8/1987 Spinner et al.
4,791,431 A * 12/1988 LaPointe ..... 343/906
4,824,401 A 4/1989 Spinner
4,842,553 A 6/1989 Ingram
5,354,217 A * 10/1994 Gabel et al. ..... 439/583
5,518,420 A 5/1996 Pitschi
5,561,900 A 10/1996 Hosler, Sr.
5,722,856 A 3/1998 Fuchs et al.
5,857,872 A 1/1999 Tettinger
5,944,556 A 8/1999 Wlos et al.
5,997,348 A * 12/1999 Shepherd ..... 439/579
6,007,378 A * 12/1999 Oeth ..... 439/588
6,032,358 A * 3/2000 Wild ..... 29/863
D436,076 S 1/2001 Montena
D437,826 S 2/2001 Montena
D440,539 S 4/2001 Montena
D440,939 S 4/2001 Montena
6,267,621 B1 7/2001 Pitschi et al.
6,386,915 B1 5/2002 Nelson
6,431,911 B2 8/2002 Pitschi
6,471,545 B1 10/2002 Hosler, Sr.
RE38,294 E 11/2003 Nattel et al.
6,733,336 B1 5/2004 Montena et al.
6,783,394 B1 8/2004 Holliday
6,830,479 B2 12/2004 Holliday
6,848,941 B2 2/2005 Wlos et al.
6,884,113 B1 * 4/2005 Montena ..... 439/578
6,939,169 B2 9/2005 Islam et al.
6,976,872 B1 12/2005 Wild et al.

(Continued)

FOREIGN PATENT DOCUMENTS

GB 2 277 207 A 10/1994

(Continued)

*Primary Examiner*—Tulsidas C. Patel
*Assistant Examiner*—Phuongchi Nguyen
(74) *Attorney, Agent, or Firm*—Marjama Muldoon Blasiak & Sullivan, LLP

(57) ABSTRACT

A compression connector for the end of a segment of corrugated coaxial cable is provided wherein the compression connector includes a clamp that is both flexible and conductive so as to enable a highly precise and secure, yet low stress engagement of the connector to the segment of corrugated coaxial cable.

46 Claims, 4 Drawing Sheets

U.S. PATENT DOCUMENTS

| | | | | |
|---|---|---|---|---|
| 7,029,326 | B2 * | 4/2006 | Montena | 439/585 |
| 7,048,579 | B2 * | 5/2006 | Montena | 439/578 |
| 7,070,447 | B1 * | 7/2006 | Montena | 439/578 |
| 7,131,868 | B2 * | 11/2006 | Montena | 439/578 |
| 7,156,696 | B1 * | 1/2007 | Montena | 439/584 |
| 7,189,115 | B1 * | 3/2007 | Montena | 439/584 |
| 2004/0253870 | A1 | 12/2004 | Johnson | |
| 2005/0159044 | A1 | 7/2005 | Harwath et al. | |
| 2005/0181652 | A1 | 8/2005 | Montena et al. | |
| 2006/0014425 | A1 * | 1/2006 | Montena | 439/578 |
| 2006/0172571 | A1 * | 8/2006 | Montena | 439/91 |

FOREIGN PATENT DOCUMENTS

| | | |
|---|---|---|
| GB | 2 277 207 B | 7/1996 |

* cited by examiner

COMPACT COMPRESSION CONNECTOR WITH FLEXIBLE CLAMP FOR CORRUGATED COAXIAL CABLE

FIELD OF THE INVENTION

This invention relates in general to terminals for coaxial cables, and, more particularly, to compact compression connectors that include a flexible, conductive clamp that can deform to facilitate a highly precise and secure, yet low stress engagement of the connector to a segment of corrugated coaxial cable.

BACKGROUND OF THE INVENTION

Coaxial cable is being deployed on a widespread basis in order to carry signals for communications networks, e.g., CATV and computer networks. Various types of coaxial cable must at some point be connected to network equipment ports. In general, it has proven difficult to adequately make such connections without requiring labor intensive effort by highly skilled technicians. Moreover, even if careful attention is paid during installation, there still can be set up errors, which, in turn, can moderately to severely affect signal quality.

These problems are likewise encountered with respect to corrugated coaxial cable (e.g., spiral, helical and annular corrugated coaxial able), which is a type of cable that includes a plurality of ridges (i.e., peaks) on its outer conductor and a recessed valley between adjoining peaks. The design of corrugated coaxial cable renders it well suited for usage conditions in which flexibility, strength and/or moisture resistance is desired, but also makes it challenging to properly engage the cable to a connector, especially in a field installation setting.

Following installation of corrugated coaxial cable, a connector ideally would snugly engage the outer conductor of the cable around the valleys and the adjoining peaks since such positioning would ensure maximum surface contact between the connector and the cable, yet also would minimize the likelihood of surface deformation of the cable as would likely occur if contact was instead made in more limited positions. Unfortunately, this ideal positioning rarely occurs in practice due to various factors, most notably the design of the portion of the connector that contacts the outer conductor of the corrugated coaxial cable.

Realizing this, many in the art have designed connectors for corrugated coaxial cable that include some type of clamping mechanism, in hopes of facilitating engagement—at an ideal position—of a connector to the corrugated coaxial cable. However, due to the design (e.g., a C-shaped design as described in U.S. Pat. No. 5,284,449 to Vaccaro, the entirety of which is incorporated by reference herein) and/or composition (e.g., metallic material) of these clamping mechanisms, such ideal positioning rarely occurs in practice. Instead, connectors that utilize clamping mechanisms tend to pinch the end of a cable at a peak. That alone is problematic; however, due to this sub-optimal positioning and as shown, e.g., in U.S. Patent Application Publication No. 2005/0159043 A1 to Harwath et al. (the entirety of which is incorporated by reference herein), an installer must expend added time and effort to precisely cut the cable at a peak and to carefully furrow out the curled or deformed cut edge to allow a supporting ledge to fit correctly inside the cut end.

It is difficult to achieve a cut precisely at a peak of corrugated coaxial cable under any circumstances, but especially in a field setting where an installer will need to use several intricate tools and cutting guides to assist in making an accurate cut at a peak, and even then there is no guarantee that the cut will be made satisfactorily. Moreover, after these exhaustive field installation steps are taken, the resulting engagement between the cable and the connector still might not actually occur at the correct position, e.g., due to the design of the clamping mechanism.

The various problems associated with such clamping mechanisms have prompted some in the art to use other devices (e.g., torroidal springs, air-chuck style ball contacts) to facilitate engagement of a connector to corrugated coaxial cable. However, in general, these other devices experience many of the same problems as have been observed with respect to clamping devices. Still other approaches ultimately cause the installation process to take an unreasonable amount of effort and/or to be cost-prohibitive. In view of the effort it takes for installers to install correctly corrugated coaxial cable based on current connector designs, it is not unheard of for them to take various short-cuts in order to save time. This is more unfortunate because in addition to the above-noted problems that can occur even with proper installation, hurried installation can lead to errors that later manifest themselves in shielding and modulation difficulties.

Thus, there is a need for a connector for corrugated coaxial cable, wherein the connector is designed to reliably engage the connector to the corrugated coaxial cable at an ideal position, yet that does not add time or cost to the installation process.

SUMMARY OF THE INVENTION

These and other needs are met by a compact compression connector for a segment of corrugated coaxial cable, wherein the segment of corrugated coaxial cable includes a center conductor, a plurality of conductive peaks, a plurality of conductive valleys, and a protective outerjacket. The end of a segment of coaxial cable is prepared by stripping away certain layers thereof at specified distances from the end of the central conductor. A portion of the protective outerjacket is stripped such that at least some conductive valleys and some conductive peaks are exposed. The compression connector is advantageous because it is both flexible and conductive, thus enabling a highly precise and secure, yet low stress engagement between the connector and the segment of corrugated coaxial cable.

In one exemplary aspect, the compression connector can comprise (a) a body that has a proximal end, a distal end and a lumen defined therebetween, (b) a compression member that has a proximal end, a distal end and a lumen defined therebetween, wherein the distal end of the compression member is in operative engagement with the body, and (c) a clamping element that is disposed within the lumen of the body and that is in operative engagement with the body and with the compression member, wherein the clamping element is formed of an elastomeric material and is conductive. The lumen is an interior passage of the body which can be of substantially uniform or of variable diameters as shown in the accompanying drawings. Upon axial advancement of the compression member in a distal direction, the connector is caused to be compressed radially so as to provide at least one contact force between the compression connector and the segment of corrugated coaxial cable.

In accordance with this or other exemplary aspects, the clamping element can be formed of various materials combinations such as a blend of an elastomeric material and at least one conductive material, or of an elastomeric material that has been coated with at least one conductive material. The elastomeric material can be, e.g., silicone rubber, and the at least one conductive material can be in a form selected from the group consisting of a metal filament, a metal powder, and a nanomaterial.

Also in accordance with this or other exemplary aspects, the distal end of the body can include a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector. Moreover, the connector can include a nut that surrounds the distal end of the body and that can be hex-shaped. When a nut is present, and if desired, the body can further include a protruding ridge against which the nut is disposed. Further, the connector can include a collet and a spacer (e.g., an insulator). If desired, the collet can be disposed within the lumen of the body and be adapted to receive the center conductor of the annular corrugated coaxial cable to establish electrical connectivity between the collet and the center conductor. Also if desired, the spacer can be disposed at a predetermined position between the collet and the body such that the center conductor of the annular corrugated coaxial cable is electrically isolated from the body. Still further, the connector can include a guide element (e.g., a seizure bushing), which is in operative engagement with the body and includes a proximal end, a distal end and a lumen defined therebetween, wherein the lumen of the guide element is sized to accommodate the center conductor of the annular corrugated coaxial cable and wherein the guide element is positioned within the lumen of the body so as to guide the center conductor of the annular corrugated coaxial cable into the collet, if included. The lumen of the guide element is also an interior passage of the guide element which can be of substantially uniform or of variable diameters as shown in the accompanying drawings. If desired, the guide element can have an outer diameter that tapers inwardly from the proximal end of the guide element to the distal end of the guide element. Also if desired, the lumen of the guide element can have a substantially constant inner diameter that is substantially equal to the outer diameter of the guide element at the distal end of the guide element.

Still also in accordance with this or other aspects, the clamping element can have an inner peripheral surface, an outer peripheral surface, a proximal surface, and a distal surface, wherein the inner peripheral surface has an inner diameter defined by the lumen of the clamping element. If desired, at least a portion of the inner peripheral surface can be pre-shaped to fit around at least some of the plurality of conductive peaks and at least some of the plurality of conductive valleys of the exposed corrugated region of the segment of corrugated coaxial cable. Moreover, one, some or each of the inner peripheral surface, the outer peripheral surface, the proximal surface and the distal surface of the clamping element can be at least partially coated or substantially entirely coated with at least one conductive material. Also, upon insertion of the segment of corrugated coaxial cable into the connector, the inner peripheral surface of the clamping element can be in operative engagement with at least a portion of the exposed corrugated region of the segment of corrugated coaxial cable and at least a portion of the outer protective jacket of the segment of corrugated coaxial cable, and/or the outer peripheral surface of the clamping element can be in operative engagement with the body and the compression member, and/or the proximal surface of the clamping element can be in operative engagement with the compression member, and/or the distal surface of the clamping element can be in operative engagement with the body.

In accordance with an exemplary aspect in which the clamping element includes an inner peripheral surface, the inner diameter of the inner peripheral surface can be substantially constant or varied. Moreover, the inner peripheral surface can be comprised of a first segment and a second segment, wherein, if desired, the first segment and the second segment can be one or both of a different inner diameter (e.g., wherein the inner diameter of the second segment can be constant or varied and is less than the inner diameter of the first segment which also can be constant or varied) and a different length (e.g., wherein the length of the first segment is less than the length of the second segment).

In accordance with an exemplary aspect in which the clamping element includes an inner peripheral surface that is comprised of a first segment and a second segment, upon insertion of the segment of corrugated coaxial cable into the connector, the exposed corrugated region of the segment of corrugated coaxial cable can become at least partially surrounded by the second segment of the inner peripheral surface of the clamp element and the outer protective jacket of the segment of corrugated coaxial cable can become at least partially surrounded by the first segment of corrugated coaxial cable. Also, if desired, upon axial advancement of the compression member in a distal direction the clamping element can be caused to be compressed radially to an extent whereby at least the second segment is caused to be deformed around at least some of the plurality of conductive peaks and at least some of the plurality of conductive valleys of the exposed corrugated region of the segment of corrugated coaxial cable so as to provide at least one contact force between the compression connector and the segment of corrugated coaxial cable.

In accordance with another exemplary aspect, the compression connector can comprise (a) a body that has a proximal end, a distal end and a lumen defined therebetween, (b) a compression member that has a proximal end, a distal end and a lumen defined therebetween, wherein the distal end of the compression member is in operative engagement with the body, and (c) a clamping element that is disposed within the lumen of the body and that is in operative engagement with the body and with the compression member, wherein the clamping element is formed of an elastomeric material and is conductive, and wherein the clamping element includes an inner peripheral surface that has an inner diameter which is defined by the lumen of the clamping element. Upon axial advancement of the compression member in a distal direction, the clamping element is caused to be compressed radially to an extent whereby at least at portion of the inner peripheral surface of the clamping element is deformed around at least some of the plurality of conductive peaks and at least some of the plurality of conductive valleys of the exposed corrugated region of the segment of corrugated coaxial cable so as to provide at least one contact force between the compression connector and the segment of corrugated coaxial cable.

In accordance with yet another exemplary aspect, the compression connector comprises (a) a body that has a proximal end, a distal end and a lumen defined therebetween, (b) a compression member that has a proximal end, a distal end and a lumen defined therebetween, wherein the distal end of the compression member is in operative engagement with the body, and (c) a clamping element that is disposed within the lumen of the body and that is in operative engagement with the body and with the compression member, wherein the clamping element is formed of an elastomeric material and is conductive, and wherein the clamping element includes an inner peripheral surface having an inner diameter defined by the lumen of the clamping element, the inner peripheral surface being comprised of a first segment and a second segment. Upon insertion of the segment of corrugated coaxial cable into the connector, the exposed corrugated region of the segment of corrugated coaxial cable becomes at least partially surrounded by the second segment of the inner peripheral surface of the clamp element and the outer protective jacket of the segment of corrugated coaxial cable becomes at least partially surrounded by the first segment of corrugated coaxial cable. And upon sliding, axial advancement of the compression member in a distal direction the clamping element is caused to be inwardly radially compressed to an extent whereby at least at portion of the second segment inner peripheral surface of the clamping element is deformed around at least some of the plurality of conductive peaks and the plurality of conductive valleys of the exposed corrugated region of the segment of corrugated coaxial cable so as to provide at least one contact force between the compression connector and the segment of corrugated coaxial cable.

Still other aspects, embodiments and advantages of these exemplary aspects are discussed in detail below. Moreover, it is to be understood that both the foregoing general description and the following detailed description are merely illustrative examples of various embodiments, and are intended to provide an overview or framework for understanding the nature and character of the claimed embodiments. The accompanying drawings are included to provide a further understanding of the various embodiments, and are incorporated in and constitute a part of this specification. The drawings, together with the description, serve to explain the principles and operations of the described and claimed embodiments.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION OF THE INVENTION

Figure 1:
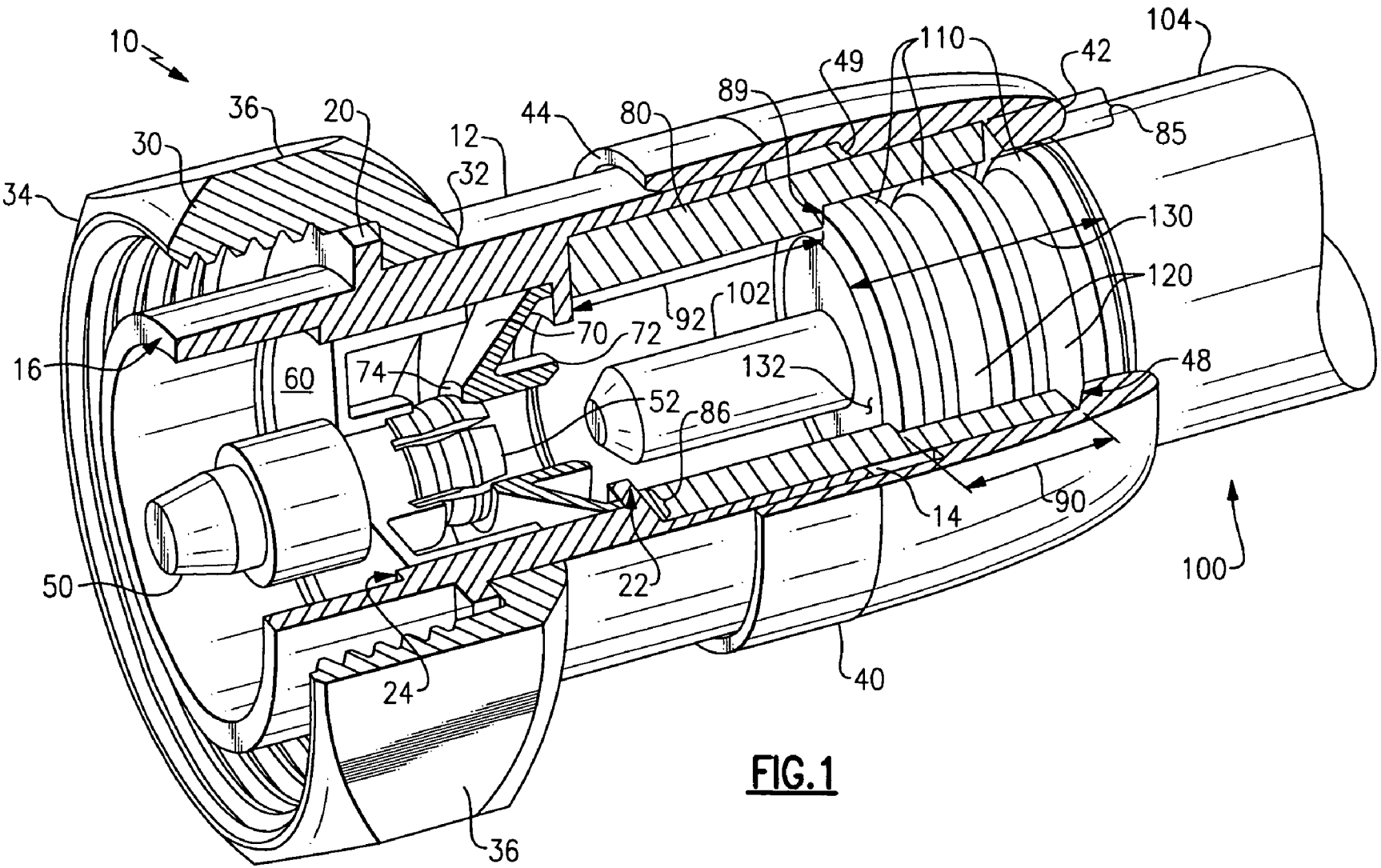
FIG. 1 is a cutaway perspective view of an exemplary compression connector during insertion of a segment of corrugated coaxial cable therewithin.
Figure 2:
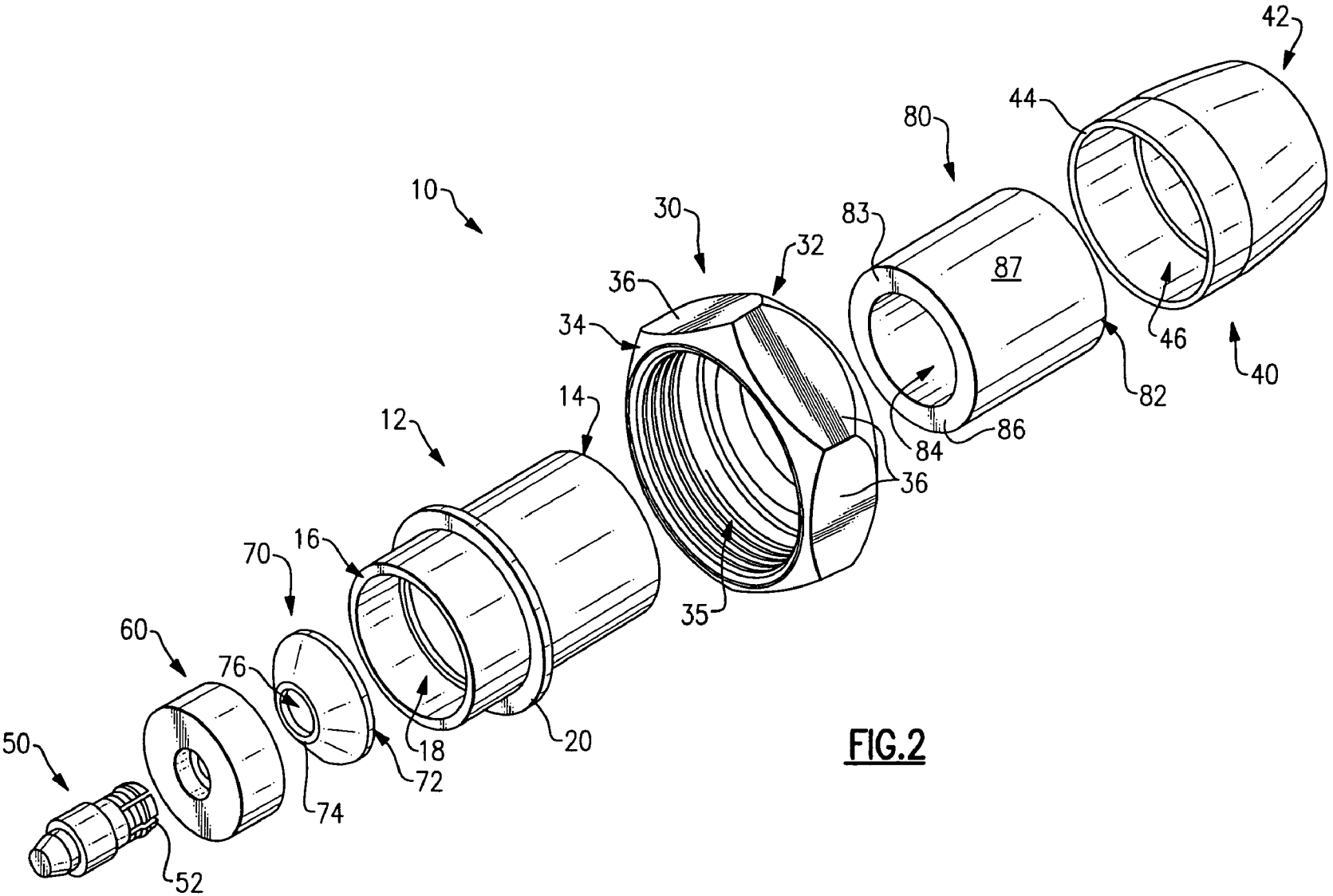
FIG. 2 is an exploded perspective view of the compression connector of FIG. 1.

Referring initially to FIGS. 1 and 2, an exemplary compression connector 10 is shown, as is a portion of a segment of corrugated coaxial cable 100. In the illustrated embodiment, the corrugated cable segment 100 is annular corrugated coaxial cable; however, it should be noted that each of the embodiments described herein is equally applicable to all types of corrugated coaxial cable, including, but not limited to, annular corrugated coaxial cable, spiral corrugated coaxial cable, and helical corrugated coaxial cable. However, regardless of the specific type of corrugated coaxial cable, and as shown in FIG. 1, the cable segment 100 generally includes a distally protruding center conductor 102, an outer protective jacket 104, a plurality of conductive corrugation peaks 110, and a plurality of conductive valleys 120. The peaks 110 and valleys 120 collectively form what is hereinafter referred to as the "exposed corrugated region" of the corrugated coaxial cable segment 100, wherein this exposed corrugated region is denoted in the Figures with reference numeral 130.

It should be noted that although the compression connector 10 is depicted in the Figures as having a DIN male connector interface, it can have other interfaces as well, including, but are not limited to, a BNC connector interface, a TNC connector interface, an F-type connector interface, an RCA-type connector interface, a DIN female connector interface, an N male connector interface, an N female connector interface, an SMA male connector interface, and an SMA female connector interface.

The compression connector 10 includes a connector body 12, which has a proximal end 14, a distal end 16 and a continuous lumen 18 defined therebetween. The connector body 12 has a generally cylindrical shape, but also includes a protruding ridge/ring 20 that surrounds the outer periphery of the connector body. The location of the ridge 20 can vary; however, in accordance with at least the exemplary embodiments shown in the Figures, the ridge 20 is located comparatively closer to the distal end 16 of the body 12.

The inner diameter of the lumen 18 of the connector body 12 can be constant or, as best shown in FIG. 1, can vary. In at least the FIG. 1 exemplary embodiment, the inner diameter of the lumen 18 of the body 12 is shaped to include a proximal shoulder 22 and a distal shoulder 24, wherein the inner diameter of the lumen is substantially constant between the proximal end 14 of the body and the proximal shoulder 22, between the proximal shoulder 22 and the distal shoulder 24, and between the distal shoulder 24 and the distal end 16 of the body 12.

The actual inner diameter of the lumen 18 of the body 12 can be the same or different for any or all of the substantially constant inner diameter portions. However, by way of non-limiting example and as shown in FIG. 1, the inner diameter of the lumen 18 at the substantially constant inner diameter portion located between the proximal shoulder 22 and the distal shoulder 24 is less than the inner diameter of the lumen 18 at the substantially constant inner diameter portion located between the distal shoulder 24 and the distal end 16 of the body 12, which, in turn, is less than the inner diameter of the lumen 18 at the substantially constant inner diameter portion located between the proximal shoulder 22 and the proximal end 14 of the body 12.

As shown in FIG. 1, the distal end 16 of the connector body 12 is surrounded by a nut 30, which has a proximal end 32, a distal end 34 and a continuous, threaded lumen 35 defined therebetween. Generally, the nut 30 is hex-shaped and includes a plurality of sides/flats 36 to enable the nut to be grasped and manipulated by a tool (not shown) or by hand when coupling the compression connector 10 to a complimentary fitting (not shown) on an equipment port (not shown) to which the cable segment 100 is to be connected.

The nut 30 is retained within its illustrated position in FIG. 1 by being disposed against the ridge 20 of the connector body 12. Although not shown in the Figures, a nut retaining element (e.g., a retaining ring) can be disposed around the connector body 12 and adjacent to the proximal end 32 of the nut 30 so as to provide added assurance that the nut will be retained in its FIG. 1 position.

A compression member 40 (e.g., a housing) is disposed at least partially over the outer periphery of the connector body 12, including over the proximal end 14 thereof. The housing 40 includes a proximal end 42, a distal end 44 and a continuous lumen 46 defined therebetween. As is currently preferred, and as is shown in FIG. 1, the proximal end 42 of the housing 40 is flanged so as to define a first shoulder 48. A second shoulder 49 is defined within the lumen 46 of the housing 40.

The connector 10 further includes a collet 50 and a spacer 60 (e.g., an insulator). The spacer 60 is positioned between the collet 50 and the body 12, such as in the FIG. 1 exemplary embodiment wherein the spacer is disposed around the collet so as to hold the collet in place. A proximal end 52 of the collet 50 provides the connection to the center conductor 102 of the inserted annular corrugated coaxial cable segment 100 to which the connector 10 is being connected, and the spacer 60 electrically insulates the collet from the connector body 12 and the conductive portions of the inserted cable segment.

Optionally, the connector 10 can include a guide element 70 (e.g., a seizure bushing), which has a proximal end 72, a distal end 74 and a lumen 76 defined therebetween. As best shown in FIG. 1, the distal end 74 of the guide element 70 is in operative engagement with the connector body 12. The outer diameter of the guide element 70 tapers inwardly from its proximal end 72 to its distal end 74 such that the guide element has a flared conical shape. Due to it having this shape, the guide element 70 is effective not only to guide the center conductor 102 of the inserted annular corrugated coaxial cable segment 100 into the collet 50, but also to maintain the collet in tight contact with the inserted cable segment. By way of non-limiting example, and as shown in FIG. 1, the inner diameter of the lumen 76 of the guide element 70 is substantially constant and is substantially identical to the outer diameter of the guide element at its distal end 74.

Figure 3A:
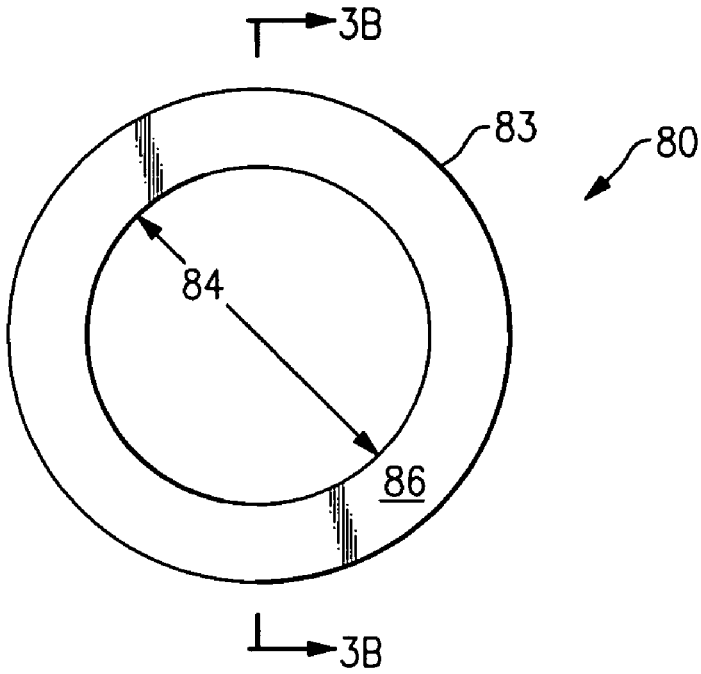
FIG. 3A is an end view of the distal surface and the distal end of the clamping element of the compression connector of FIGS. 1 and 2.
Figure 3B:
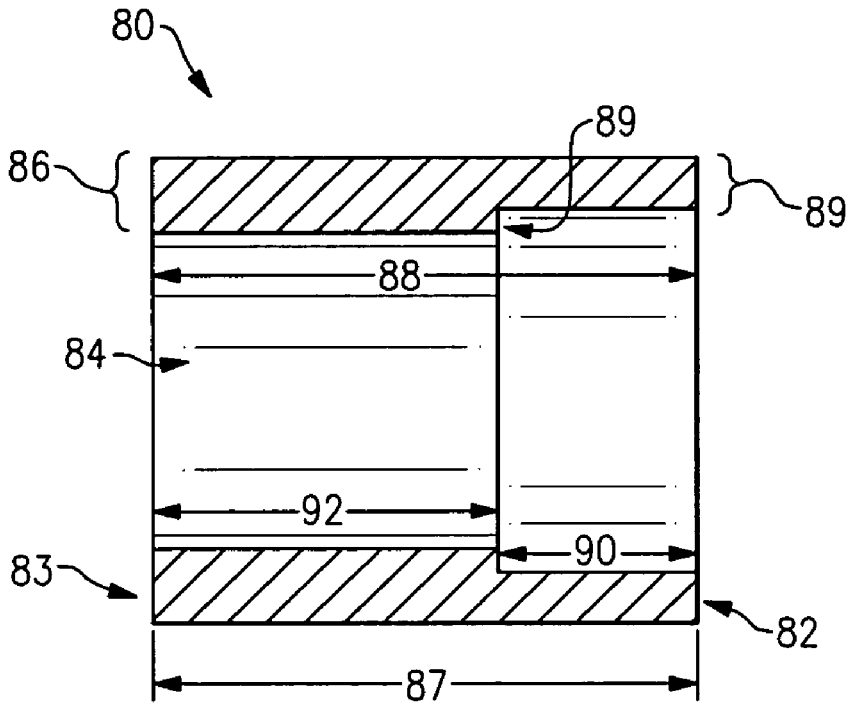
FIG. 3B is a side, cross-sectional view of the clamping element of FIG. 3A taken along line 3B-3B of FIG. 3A.
Figure 4:
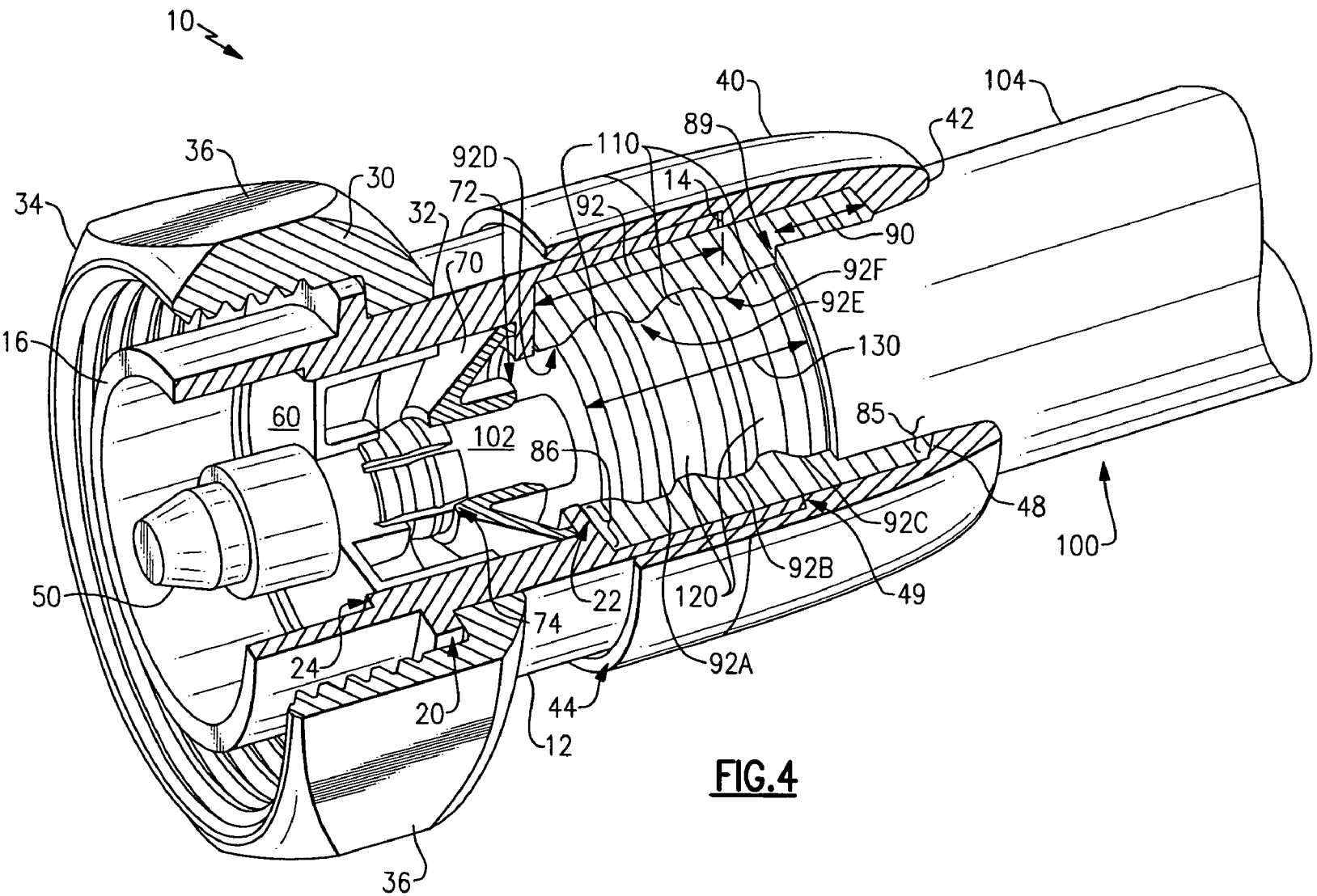
FIG. 4 is a cutaway perspective view of the compression connector of FIG. 1 after a segment of corrugated coaxial cable has been fully inserted therein and compressed.

The connector 10 further includes a clamping element ("clamp") 80 shown in detail in FIGS. 2, 3A and 3B. The clamp 80 includes a proximal end 82, a distal end 83 and a continuous lumen 84 defined therebetween. As best shown in FIGS. 1 and 4, the clamp 80 further includes a proximal surface 85, which is in operative engagement with the flanged shoulder 48 of the housing both prior to and following insertion of the cable segment 100 within the connector 10, a distal surface 86, which is in operative engagement with the proximal surface 22 of the lumen 18 of the connector body 12 both prior to and following insertion of the cable segment within the connector, and an outer peripheral surface 87, which is in operative engagement with the connector body 12 and the housing 40 both prior to and following insertion of the cable segment 100 within the connector.

The clamp 80 further includes an inner peripheral surface 88, the inner diameter of which can be constant or, if desired, can vary. The various Figures depict an exemplary embodiment in which the inner diameter of inner peripheral surface 88 varies, wherein its inner diameter is substantially constant within a first constant inner diameter segment 90 located between the proximal end 82 of the clamp and a transition shoulder 89 and is also constant within a second constant inner diameter segment 92 located between the distal end 84 of the clamp and the transition shoulder 89.

The actual inner diameter of the lumen 86 of the clamp 80 can be the same or different for the first and second constant inner diameter segments 90, 92. However, by way of non-limiting example and as shown in FIG. 1, the inner diameter of second constant inner diameter segment 92 is less than the inner diameter of first constant inner diameter segment 90. Moreover, also by way of non-limiting example and as shown in FIG. 1 as well, the length of the first constant inner diameter segment 90 is less than the length of the second constant inner diameter segment 92. The respective relationships between the lengths and inner diameters of the inner diameter segments 90, 92 enable the clamp 50 to securely engage—at an ideal position—the segment of corrugated coaxial cable 200, as will be explained in further detail below.

It is currently preferred for at least certain portions of the clamp 80 to be both flexible and conductive. The flexibility characteristic of the clamp 80 enables the corrugated coaxial cable segment 100 to be easily insertable into the connector 10 and also allows the clamp to be deformable so as to fit precisely within the alternating peaks 110 and valleys 120 of the exposed corrugation region 130 of the corrugated coaxial cable segment 100. To that end, the clamp 80 generally should exhibit elastomeric behavior over a temperature range of about −40° C. to about 65° C. The conductivity characteristic of the clamp 80 is beneficial in that it will not inhibit the necessary electrical connection between the corrugated coaxial cable segment 100 and the connector 10, yet also will act as an RF shield. To that end, the clamp 80 should exhibit bulk or surface conductivity values similar to those of 360 Brass and should exhibit RF screening of less than −140 dB when exposed to a 10V/m RF field (0-1 GHz).

The desired combination of flexibility and conductivity characteristics of the clamp 80 can be achieved in several ways. In accordance with a first exemplary embodiment, the clamp 80 is made of an elastomeric material (e.g., silicone rubber) with which one or more conductive materials has/have been blended or combined or in which one or more conductive materials has/have been embedded, distributed or otherwise introduced. The conductive material(s) can be introduced into or combined with the elastomeric material via a suitable technique known in the art, including, but not limited to, impregnation, molding, doping or casting. In accordance with such an embodiment, the one or more conductive materials, when introduced or combined with the elastomeric material, can be in the form of one or more metal filaments (e.g., steel, brass, and/or bronze), one or more metal particles/powders (e.g., carbon, titanium, zirconium, barium, tantalum, hafnium, silicon, magnesium, manganese, aluminum, iron, chromium, and/or cobalt), and/or one or more so-called nanomaterials (e.g., carbon nanotubes, nickel-based nanomaterials, iron-based nanomaterials). By way of non-limiting example, the clamp 80 can be formed using silicone rubber as the elastomeric material, which can be doped with carbon nanotubes as the conductive material.

In accordance with a second exemplary embodiment, a layer, coating or skin of one or more conductive materials is deposited onto at least a portion of the clamp 80. Although a coating, layer or skin of the one or more conductive materials also can be formed on all surface of the clamp, it is generally not necessary to do so as discussed further below. Suitable techniques for depositing the layer, coating or skin of conductive material(s) onto the one or more predetermined surfaces of the clamp 80 include, but are not limited to, known techniques such as thermal spray coating (e.g., combustion torch, electric arc, or plasma spraying), physical vapor deposition (e.g., ion plating, ion implantation, sputtering, laser surface alloying, laser cladding) and chemical vapor deposition.

In accordance with each of the first and second exemplary embodiments, the selected one or more conductive materials should adhere well to the elastomeric material of the clamp 80, should not react adversely with either the elastomeric material of the clamp or the metal material of the outer conductor 102 of the cable segment 100, and should provide RF shielding but not cause RF interference.

In accordance with a third exemplary embodiment, the clamp 80 can be formed in whole or in part from a so-called "metal rubber" conductive elastomeric material. Suitable such "metal rubber" materials include but are not limited to those commercially available from Nanosonic, Inc. of Blacksburg, Virginia USA. The "metal rubber" material also should not react adversely with the metal material of the outer conductor 102 of the cable segment 100, and should provide RF shielding but not cause RF interference.

Referring now to FIG. 4, the connector 10 of FIG. 1 is shown after the segment of corrugated coaxial cable 100 has been inserted therein. During its insertion, the cable segment is axially advanced in a distal direction until the proximal end 132 of the exposed corrugated region 130 of the cable segment 100 reaches the transition shoulder 89 of the clamp, which acts as a temporary stop for the cable segment but beyond which the exposed corrugated region of the cable segment can be distally advanced due to the at least partially elastomeric composition of the clamp 80. As this further distal advancement of the cable segment 100 occurs, the various peaks 110 and valleys 120 of the exposed corrugated region 130 of the cable segment 100 become at least partially (or, as shown and as currently preferred, substantially entirely) surrounded by the second constant inner diameter segment 92 of the inner peripheral surface 88 of the clamp 80, and the protective outerjacket 104 of the cable segment 100 becomes at least partially surrounded by the first constant inner diameter segment 90 of the inner peripheral surface of the clamp.

Although not shown in the Figures, the second constant inner diameter segment 92 of the inner peripheral surface 88 could be pre-shaped to fit around the peaks 110 and valleys 120 of the exposed corrugated region 130 of the cable segment 100—that is, rather than having a substantially uniform, annular shape as shown in the Figures, the second constant inner diameter segment could be pre-shaped to match the peaks and valleys as manufactured. Such pre-shaping can occur as in generally known in the art, e.g., by molding.

Pre-shaping the second constant inner diameter segment 92 can have several advantages. For one, the elastomeric material need not be as flexible as is necessary when the second constant inner diameter segment is not pre-shaped. Moreover, if the second constant inner diameter segment 92 is pre-shaped, then an installer may be better able to determine (e.g., by sight and/or sound) when proper insertion of the cable segment 100 has occurred.

Referring again to FIG. 4, the connector 10 is shown after it has been compressed through use of a compression tool (not shown). The compression tool can be, by way of non-limiting example, a tool that includes two coaxially mounted driving bolts, wherein one driving bolt is placed against the housing 60 and the other against the spacer 120 and whereby the bolts are axially moved toward each other so as to cause the proximal end 14 of the body 12 to contact the shoulder 89 such that the connector 10 is radially compressed onto the cable segment 100.

As the connector 10 is compressed, the cable segment 100 becomes snugly engaged within the connector. Specifically, the second constant inner diameter segment 92 of the clamp deforms such that it becomes shaped to include recessed portions 92A, 92B, 92C that fit over/around corrugated peaks 110 of the exposed corrugated region 130 of the cable segment and non-recessed portions 92D, 92E, 92F that fit around/within the valleys 120 of the exposed corrugated region of the cable segment. If, instead, the second constant inner diameter segment 92 of the clamp 80 is pre-shaped as discussed above, then the FIG. 4 position of the exposed corrugated region 130 of the clamp with respect to the cable segment 100 will be the same; however, deformation of the second constant inner diameter segment generally would not have occurred in order for the second constant inner diameter segment to be shaped as shown.

Following compression of the connector 10, and regardless of whether the second constant inner diameter segment 92 is or is not pre-shaped, an even, snug yet low stress, moisture sealed, conductive contact is formed between the connector and the cable segment 100 at the exposed corrugation region 130. Moreover, the maximum surface contact that is achieved and shown in FIG. 4 enables the cable segment 100 to be prepared by being cut at a valley 120, rather than at a peak 110 as is conventionally done. That, in turn, simplifies the installation process, since it is comparatively easier for an installer to use a simple tool such as a knife, saw or other bladed instrument to track and make a cut at a valley 120.

To ensure that the proper conductive path exists between the connector 10 and the cable segment 100, at least a portion of the clamp 80 contains or is coated with conductive material, e.g., via one or more of the techniques discussed above. By way of non-limiting example, each of the surfaces 85, 86, 87, 88 of the clamp 80 can contain or are coated with at least one conductive material. However, based on the post-insertion and compression position and shape of the cable segment 100 with respect to the connector 10, it is unnecessary for the entirety of one, some or each of the surfaces 85, 86, 87, 88 of the clamp 80 to be conductive. This is beneficial, because it enables a well functioning clamp 80 to be formed using less overall conductive material, thus, in turn, reducing the cost of making the connector 10. To that end, and in accordance with an exemplary embodiment in which the one or more conductive materials is/are formed as a coating, skin or layer on the clamp 80, only the entirety of the distal surface 86 includes a skin, coating or layer of one or more conductive materials, whereas the second constant inner diameter segment 92 of the clamp is entirely or selectively coated with the one or more conductive materials, and wherein each of the first constant inner diameter segment 90, the proximal surface 85 and the outer periphery surface 87 is either partially coated with one or more conductive materials or is not coated with any conductive materials.

This selective coating of the clamp 80 also can occur if, instead of being present as a skin, layer or coating, the one or more conductive materials are combined with or otherwise introduced into the clamp 80. In such an embodiment, and by way of non-limiting example, the conductive materials can be selectively placed within a mold so as to be present only at the desired areas of the clamp 80.

Although various embodiments have been described herein, it is not intended that such embodiments be regarded as limiting the scope of the disclosure, except as and to the extent that they are included in the following claims—that is, the foregoing description is merely illustrative, and it should be understood that variations and modifications can be effected without departing from the scope or spirit of the various embodiments as set forth in the following claims. Moreover, any document(s) mentioned herein are incorporated by reference in its/their entirety, as are any other documents that are referenced within such document(s).

We claim:

1. A compression connector for the end of a segment of corrugated coaxial cable, the segment of corrugated coaxial cable including a center conductor, an outer protective jacket, and an exposed corrugated region including at least a plurality of conductive peaks and a plurality of conductive valleys, the compression connector comprising:

a body having a proximal end, a distal end and an interior passage defined therebetween;

a compression member having a proximal end, a distal end and an interior passage defined therebetween, wherein the distal end of the compression member is in operative engagement with the body; and a clamping element disposed within the interior passage of the body and in operative engagement with the body and with the compression member, the clamping element being formed from an elastomeric conductive material, wherein upon axial advancement of the compression member in a distal direction the clamping element is compressed and inwardly radially deformed into at least one of the conductive valleys of the segment of corrugated coaxial cable.

2. The compression connector of claim 1, wherein the distal end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

3. The compression connector of claim 1, wherein the clamping element is formed from an elastomeric material that has been coated with at least one conductive material.

4. The compression connector of claim 3, wherein each of the at least one conductive material is in a form selected from the group consisting of a metal filament, a metal powder, and a nanomaterial.

5. The compression connector of claim 1, further comprising:

a nut surrounding the distal end of the body.

6. The compression connector of claim 5, wherein the nut is hex-shaped.

7. The compression connector of claim 5, wherein the body includes a protruding ridge and wherein the nut is disposed against the protruding ridge.

8. The compression connector of claim 1, wherein the clamping element is formed from a blend of an elastomeric material and at least one conductive material.

9. The compression connector of claim 8, wherein the elastomeric material is silicone rubber.

10. The compression connector of claim 8, wherein each of the at least one conductive material is in a form selected from the group consisting of a metal filament, a metal powder, and a nanomaterial.

11. The compression connector of claim 1, further comprising: a collet disposed within the interior passage of the body and adapted to receive the center conductor of the segment of corrugated coaxial cable to establish electrical connectivity between the collet and the center conductor.

12. The compression connector of claim 11, further comprising: a spacer disposed at a predetermined position between the collet and the body such that the center conductor of the segment of corrugated coaxial cable is electrically isolated from the body.

13. The compression connector of claim 12, wherein the spacer is an insulator.

14. The compression connector of claim 11, further comprising: a guide element in operative engagement with the body, the guide element having a proximal end, a distal end and an interior passage defined therebetween, wherein the interior passage of the guide element is sized to accommodate the center conductor of the segment of corrugated coaxial cable and wherein the guide element is positioned within the interior passage of the body so as to guide the center conductor of the segment of corrugated coaxial cable into the collet.

15. The compression connector of claim 14, wherein the guide element has an outer diameter that tapers inwardly from the proximal end of the guide element to the distal end of the guide element.

16. The compression connector of claim 14, wherein the interior passage of the guide element has a substantially constant inner diameter, and wherein the substantially constant inner diameter of the interior passage is substantially equal to the outer diameter of the guide element at the distal end of the guide element.

17. The compression connector of claim 14, wherein the guide element is a seizure bushing.

18. The compression connector of claim 1, wherein the clamping element has an inner peripheral surface, an outer peripheral surface, a proximal surface and a distal surface, the inner peripheral surface having an inner diameter defined by the interior passage of the clamping element.

19. The compression connector of claim 18, wherein at least a portion of the inner peripheral surface is pre-shaped to fit around at least some of the plurality of conductive peaks and at least some of the plurality of conductive valleys of the exposed corrugated region of the segment of corrugated coaxial cable.

20. The compression connector of claim 18, wherein each of the inner peripheral surface, the outer peripheral surface, the proximal surface and the distal surface of the clamping element is at least partially coated with at least one conductive material.

21. The compression connector of claim 18, wherein upon insertion of the segment of corrugated coaxial cable into the connector, the inner peripheral surface of the clamping element is in operative engagement with at least a portion of the exposed corrugated region of the segment of corrugated coaxial cable and at least a portion of the outer protective jacket of the segment of corrugated coaxial cable, and the outer peripheral surface of the clamping element is in operative engagement with the body and the compression member, and the proximal surface of the clamping element is in operative engagement with the compression member, and the distal surface of the clamping element is in operative engagement with the body.

22. The compression connector of claim 18, wherein the inner diameter of the inner peripheral surface of the clamping element is substantially constant.

23. The compression connector of claim 18, wherein the inner diameter of the inner peripheral surface of the clamping element is varied.

24. The compression connector of claim 18, wherein at least one, but fewer than each of the inner peripheral surface, the outer peripheral surface, the proximal surface and the distal surface of the clamping element is at least partially coated with at least one conductive material.

25. The compression connector of claim 24, wherein at least a portion of the inner peripheral surface and at least a portion of the distal surface are coated with at least one conductive material.

26. The compression connector of claim 25, wherein substantially the entire distal surface is coated with at least one conductive material.

27. The compression connector of claim 18, wherein the inner peripheral surface of the clamping element includes a first segment and a second segment.

28. The compression connector of claim 27, wherein upon insertion of the segment of corrugated coaxial cable into the connector, the exposed corrugated region of the segment of corrugated coaxial cable becomes at least partially surrounded by the second segment of the inner peripheral surface of the clamp element and the outer protective jacket of the segment of corrugated coaxial cable becomes at least partially surrounded by the first segment of corrugated coaxial cable.

29. The compression connector of claim 28, wherein upon axial advancement of the compression member in a distal direction the clamping element is caused to be compressed radially to an extent whereby at least the second segment is caused to be deformed around at least some of the plurality of conductive peaks and at least some of the plurality of conductive valleys of the exposed corrugated region of the segment of corrugated coaxial cable so as to provide at least one contact force between the compression connector and the segment of corrugated coaxial cable.

30. The compression connector of claim 27, wherein the first segment and the second segment of the inner peripheral surface have at least one of a different inner diameter and a different length.

31. The compression connector of claim 30, wherein the length of the first segment is less than the length of the second segment.

32. The compression connector of claim 30, wherein the inner diameter of the second segment is less than the inner diameter of the first segment.

33. The compression connector of claim 32, wherein the first segment has a substantially constant inner diameter and the second segment has a substantially constant inner diameter less than the inner diameter of the first segment.

34. A compression connector for the end of a segment of corrugated coaxial cable, the segment of corrugated coaxial cable including a center conductor, an outer protective jacket, and an exposed corrugated region including at least a plurality of conductive peaks and a plurality of conductive valleys, the compression connector comprising:

a body having a proximal end, a distal end and an interior passage defined therebetween;

a compression member having a proximal end, a distal end and an interior passage defined therebetween, wherein the distal end of the compression member is in operative engagement with the body; and a clamping element disposed within the interior passage of the body and in operative engagement with the body and with the compression member, the clamping element being formed from an elastomeric conductive material, wherein the clamping element includes an inner peripheral surface having an inner diameter defined by the interior passage of the clamping element, wherein upon axial advancement of the compression member in a distal direction the clamping element is caused to be compressed radially to an extent whereby at least at portion of the inner peripheral surface of the clamping element is deformed around the at least some of the plurality of conductive peaks and into at least one of the plurality of conductive valleys of the exposed corrugated region of the segment of corrugated coaxial cable so as to provide at least one contact force between the compression connector and the segment of corrugated coaxial cable.

35. The compression connector of claim 34, wherein the distal end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

36. The compression connector of claim 34, wherein the clamping element is formed from a blend of an elastomeric material and at least one conductive material.

37. The compression connector of claim 34, wherein the clamping element is formed from an elastomeric material coated with at least one conductive material.

38. The compression connector of claim 34, wherein the inner peripheral surface of the clamping element includes a first segment and a second segment.

39. The compression connector of claim 38, wherein the first segment and the second segment of the inner peripheral surface have at least one of a different inner diameter and a different length.

40. The compression connector of claim 38, wherein upon insertion of the segment of corrugated coaxial cable into the connector, the exposed corrugated region of the segment of corrugated coaxial cable becomes at least partially surrounded by the second segment of the inner peripheral surface of the clamp element and the outer protective jacket of the segment of corrugated coaxial cable becomes at least partially surrounded by the first segment of corrugated coaxial cable.

41. The compression connector of claim 40, wherein upon axial advancement of the compression member in a distal direction the clamping element is caused to be compressed radially to an extent whereby at least the second segment is caused to be deformed around at least some of the plurality of conductive peaks and at least some of the plurality of conductive valleys of the exposed corrugated region of the segment of corrugated coaxial cable so as to provide at least one contact force between the compression connector and the segment of corrugated coaxial cable.

42. A compression connector for the end of a segment of corrugated coaxial cable, the segment of corrugated coaxial cable including a center conductor, an outer protective jacket, and an exposed corrugated region including at least a plurality of conductive peaks and a plurality of conductive valleys, the compression connector comprising:

a body having a proximal end, a distal end and a lumen an interior passage defined therebetween;

a compression member having a proximal end, a distal end and a lumen an interior passage defined therebetween, wherein the distal end of the compression member is in operative engagement with the body; and a clamping element disposed within the interior passage of the body and in operative engagement with the body and with the compression member, the clamping element being formed from an elastomeric material and being conductive, wherein the clamping element includes an inner peripheral surface having an inner diameter defined by the interior passage of the clamping element, the inner peripheral surface being comprised of a first segment and a second segment, wherein upon insertion of the segment of corrugated coaxial cable into the connector, the exposed corrugated region of the segment of corrugated coaxial cable becomes at least partially surrounded by the second segment of the inner peripheral surface of the clamp element and the outer protective jacket of the segment of corrugated coaxial cable becomes at least partially surrounded by the first segment of corrugated coaxial cable, and wherein upon axial advancement of the compression member in a distal direction the clamping element is caused to be compressed radially to an extent whereby at least at portion of the second segment inner peripheral surface of the clamping element is deformed around at least some of the plurality of conductive peaks and at least some of the plurality of conductive valleys of the exposed corrugated region of the segment of corrugated coaxial cable so as to provide at least one contact force between the compression connector and the segment of corrugated coaxial cable.

43. The compression connector of claim 42, wherein the distal end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

44. The compression connector of claim 42, wherein the clamping element is formed from a blend of an elastomeric material and at least one conductive material.

45. The compression connector of claim 42, wherein the clamping element is formed from an elastomeric material coated with at least one conductive material.

46. The compression connector of claim 42, wherein the first segment and the second segment of the inner peripheral surface have at least one of a different inner diameter and a different length.

* * * * *

UNITED STATES PATENT AND TRADEMARK OFFICE

CERTIFICATE OF CORRECTION

PATENT NO. : 7,311,554 B1
APPLICATION NO. : 11/505961
DATED : December 25, 2007
INVENTOR(S) : David Jackson et al.

It is certified that error appears in the above-identified patent and that said Letters Patent is hereby corrected as shown below:

Claim 42:

i) Col. 14, Lines 53-54: Please delete the words "a distal end and a lumen an interior passage" and replace with --a distal end and an interior passage--;

ii) Col. 14, Line 56: Please delete the words "end and a lumen an interior passage" and replace with --end and an interior passage--;

Signed and Sealed this

Twenty-ninth Day of April, 2008

JON W. DUDAS
*Director of the United States Patent and Trademark Office*